US007278462B2

(12) United States Patent
Purdy et al.

(10) Patent No.: US 7,278,462 B2
(45) Date of Patent: Oct. 9, 2007

(54) ENGINE BLOCK DIE-CASTING APPARATUS HAVING MECHANICALLY ACTUATED BANK CORE SLIDES

(75) Inventors: Jim Purdy, Pain Court (CA); Kevin Van Damme, Wallaceburg (CA); David Gaylard, Wallaceburg (CA)

(73) Assignee: Aar-Kel Enterprises, Inc., Wallaceburg (CA)

( * ) Notice: Subject to any disclaimer, the term of this patent is extended or adjusted under 35 U.S.C. 154(b) by 0 days.

(21) Appl. No.: 11/350,243

(22) Filed: Feb. 8, 2006

(65) Prior Publication Data

US 2006/0207741 A1 Sep. 21, 2006

Related U.S. Application Data

(60) Provisional application No. 60/652,360, filed on Feb. 11, 2005.

(51) Int. Cl.
*B22D 17/26* (2006.01)
*B22D 33/04* (2006.01)

(52) U.S. Cl. ..... 164/312; 164/137; 164/340

(58) Field of Classification Search ..... 164/137, 164/302, 312, 340–342
See application file for complete search history.

(56) References Cited

U.S. PATENT DOCUMENTS

| | | | | |
|---|---|---|---|---|
| 3,165,796 | A | 1/1965 | McDonald | 22/93 |
| 3,433,292 | A | 3/1969 | McDonald | 164/343 |
| 3,596,708 | A | 8/1971 | Lapin | 164/343 |
| 5,323,840 | A * | 6/1994 | Usui et al. | 164/332 |
| 5,698,243 | A * | 12/1997 | Wakabayashi | 425/545 |
| 5,865,241 | A | 2/1999 | Bishenden et al. | 164/137 |
| 6,761,208 | B2 | 7/2004 | Whealy et al. | 164/340 |
| 2005/0098295 | A1 * | 5/2005 | Dubay | 164/312 |

* cited by examiner

*Primary Examiner*—Kuang Y. Lin
(74) *Attorney, Agent, or Firm*—Bliss McGlynn, P.C.

(57) ABSTRACT

An engine block die-casting apparatus of the present invention includes a stationary element, an ejector holder block adapted to be operatively movable to and from the stationary element, and an ejector box. The apparatus also includes a pair of side slide cores and at least one bank core slide assembly that is slidably mounted and mechanically actuated within the ejector holder block. The stationary element, the ejector holder block, the pair of side slide cores, and the bank core slide assembly are adapted to be moved proximate each other so as to create a closed die-cast cavity and to be drawn apart from one another to allow extraction of the cast engine block.

17 Claims, 3 Drawing Sheets

ENGINE BLOCK DIE-CASTING APPARATUS HAVING MECHANICALLY ACTUATED BANK CORE SLIDES

CROSS REFERENCE TO RELATED APPLICATIONS

This application claims the benefit of U.S. provisional patent application entitled "Engine Block Die-Casting Apparatus Having Mechanically Actuated Bank Core Slides," having Ser. No. 60/652,360, and filed on Feb. 11, 2005.

BACKGROUND OF THE INVENTION

1. Field of the Invention

The present invention relates, generally, to a die-casting apparatus and, more specifically, to a die-casting apparatus having mechanically actuated bank core slide assemblies to produce die-cast engine blocks.

2. Description of the Related Art

Die-casting is widely used in the manufacture of component parts in the automotive industry. Die-casting can provide component parts having complex shapes and surfaces with a high degree of accuracy, which reduces the need for additional machining steps. Furthermore, the accuracy of die-casting provides highly repeatable production processes that can be automated to provide labor cost savings and speed. One notable application of automated die-casting processes in the automotive industry is the die-cast forming of engine blocks. Engine blocks have extensive and complex surfaces with close tolerances and producing them by die-casting permits rapid and accurate production that eliminates a number of costly machining operations and saves time and material. However, die-casting of engine blocks requires that the die-casting dies, or apparatuses form an accurate die cavity that must be capable of withstanding not only the high temperature of the molten metal, but also the extreme pressures applied to the molten metal to force it into the smallest portions of the die cavity.

To form the die cavity necessary to produce an engine block, conventional die-casting dies are fitted with a number of die elements and die cores that operatively cooperate with each other. The majority of die elements and cores are movable with respect to a single stationary element such that the movable elements are closed about the stationary element to form the die cavity and are retracted from the stationary element to open and allow extraction of the cast engine block. Generally, conventional die-cast dies have a stationary element, two movable side elements, and several slidable elements that provide cores to form the cylinder bores when the engine block is cast. Due to their large and heavy nature, conventional die-casting dies hydraulically drive the movable elements and the slide elements between their open and closed positions. When driven to the closed position, the alignment and the placement of the cylinder cores within the die cavity are critical as misalignment can vary wall thicknesses and distort surface dimensions to unacceptable limits and result in a substantial waste of die-cast parts.

Conventional die-casting dies have generally been able to adequately deal with difficulties in producing engine blocks. However, there is still room for improvement in the design of these devices that would allow for greater efficiency and cost savings. This is especially true as the die-casting process applies to the production of engine blocks having a "V" cylinder configuration. In particular, the die-casting of a "V" type engine block requires a pair of cylinder-forming, die core slide elements that are positioned within the die cavity at an offset angle to each other. Each of the core slides include a plurality of core inserts that form the cylinder bores within the engine block casting. Thus, the core inserts of the two core slide form two "banks" of cylinder bores within the engine block. These "bank" core slides are movably mounted within a portion of the die-casting dies generally known as the ejector holder so that they can be extended into the die cavity for the casting process and extracted to release the cast engine block.

The ejector holder is one of the movable elements of the die-casting dies, which is driven toward the stationary element to close the die-cavity. Two opposing side core slides are actuated to move perpendicular to the ejector holder and provide the side molding surfaces of the die cavity with respect to the stationary element and the ejector holder. The side core slides, the ejector holder, and the bank core slide assemblies are moved against the stationary element and locked in place to close the die cavity.

When die-casting an engine block, properly locking the bank core slide assemblies and accurately retaining them in the desired position to maintain the dimensional stability of the bank core slides, and thus the cast cylinder bores is somewhat problematic. The dimensional instabilities of the bank core slide assemblies are most often compensated for by casting thicker cylinder walls and performing additional machining steps. However, this is not a cost effective solution and not only increases the costs of materials but also increases the time and labor costs in producing a usable engine block. Accordingly, there remains a need in the related art for an engine block die-casting apparatus that ensures an accurate and highly repeatable placement of the bank core slide assemblies in the die cavity such that dimensional stability is ensured.

Additionally, forming of the cylinder walls in a die-cast engine block places a great deal of formed metal about the core inserts of the bank core slides. The quantity of metal in the formed cylinder walls about the core inserts is necessary to provide the proper strength and integrity to the cast block. However, the solidified cast metal tends to hold the core inserts and the bank core slide assemblies in place and makes extraction of the core inserts from the formed cylinder bores difficult. Thus, conventional die-casting dies utilize large hydraulic actuating assemblies to provide the force necessary to extract the core inserts from the cast engine block. These large hydraulic actuating assemblies require high hydraulic pressures to overcome the hold of the cast metal on each of the core inserts. Furthermore, due to the length of the stroke necessary to extract the cores inserts from the cast engine block and their sheer physical size, the hydraulic actuating assemblies must be located outside of the ejector holder block and back from the bank core slides. This necessitates further complexity in connecting the bank core slide assemblies to the externally mounted hydraulic actuating assemblies. Accordingly, there remains a need in the related art for an engine block die-casting apparatus that eliminates the large and complex hydraulic actuating assemblies for moving the bank core slide assemblies as found in conventional die-casting machines and that employs a simplified and compact bank core slide actuation system.

In addition to these issues, as in all die-casting processes, some small quantities of the extra molten casting material escapes from, or is forced into the areas where the die elements join. As this extra material solidifies, it forms waste casting debris. In the die-casting of engine blocks, the debris, or "flashing" must be cleaned from the die elements and the core inserts of the die-casting machine before the next casting event. Any flashing that remains attached to, or between, the die elements and core inserts of the die-casting dies will interfere with the next die-casting process and may damage subsequent castings if it is not removed after each casting extraction. Conventional die-casting dies are generally not capable of self-cleaning or clearing the flashing so that human intervention is required to ensure that the die elements and cores are clear of flashing and debris after each casting event. This is a time consuming and difficult procedure to perform in the tight, highly heated confines of an engine block die-casting machine. Accordingly, there remains a need in the related art for an engine block die-casting apparatus that provides a means for automated clearing of the flash and debris formed during the casting process.

Furthermore, conventional die-casting dies fail to address the dissipation of the heat inherent in the die-casting process. This disregard of the heat from the casting process negatively affects the maintenance and repair costs. More specifically, the heat of the molten metal when injected into the die cavity and the dissipating heat of the metal as it forms into an engine block is transferred into the die elements and core inserts of the die-casting machine. The conventional bank core slide assemblies and core inserts for the die-casting of engine blocks are not operatively cooled when extracted from the cast engine block and are merely recycled to the closed position for the next casting process. This affects the dimensional stability of the core inserts. As the core inserts are exposed to the cooler ambient air and before they are recycled back into the closed die, the heat dissipates unevenly from the core inserts and the bank core slides. This uneven dissipation introduces temperature differences and subsequent dimensional differences or instabilities between the core inserts of the two bank core slide assemblies and between the individual core inserts of each bank, which may cause unacceptable dimensional variations.

In addition, the core slides become heat stressed such that their metallurgical properties change causing them to wear rapidly in their interaction with the formed castings. This rapid wearing of the core inserts requires that they be replaced often, which greatly adds to the maintenance costs and down time of the die-casting dies. Accordingly, there remains a need in the related art for an engine block die-casting apparatus that provides a means for operatively cooling the core inserts in each of the banks between the casting cycles.

SUMMARY OF THE INVENTION

The disadvantages of the related art are overcome by an engine block die-casting apparatus of the present invention that includes a stationary element, an ejector holder block adapted to be operatively movable to and from the stationary element, and an ejector box. The apparatus also includes a pair of side slide cores and at least one bank core slide assembly that is slidably mounted and mechanically actuated within the ejector holder block. The stationary element, the ejector holder block, the pair of side slide cores, and the bank core slide assembly are adapted to be moved proximate each other so as to create a closed die-cast cavity and to be drawn apart from one another to allow extraction of the cast engine block.

In this manner, the present invention overcomes the inefficiencies and high operational and maintenance costs of conventional die-casting machines employed to produce engine blocks. The present invention eliminates the requirement for large complex hydraulic cylinders and their associated hardware to insert and extract the bank core slide assemblies into and out of the die cavity. By employing mechanically, rather than hydraulically actuated bank core slides, the present invention ensures an accurate, highly repeatable, and dimensional stable placement of the bank core slide assemblies in the die cavity. Additionally, by eliminating the complex arrangement of hydraulic cylinders and actuators that are normally mounted outside the ejector holder block in conventional die-casting machines, the present invention allows a full lock of the die elements against the rear of the bank core slides. This locking feature provides further enhanced dimensional stability of the bank core slide assemblies over that of the conventional die-casting machines.

Other objects, features, and advantages of the present invention will be readily appreciated, as the same becomes better understood after reading the subsequent description taken in connection with the accompanying drawings.

DETAILED DESCRIPTION OF THE PREFERRED EMBODIMENT(S)

Figure 1:
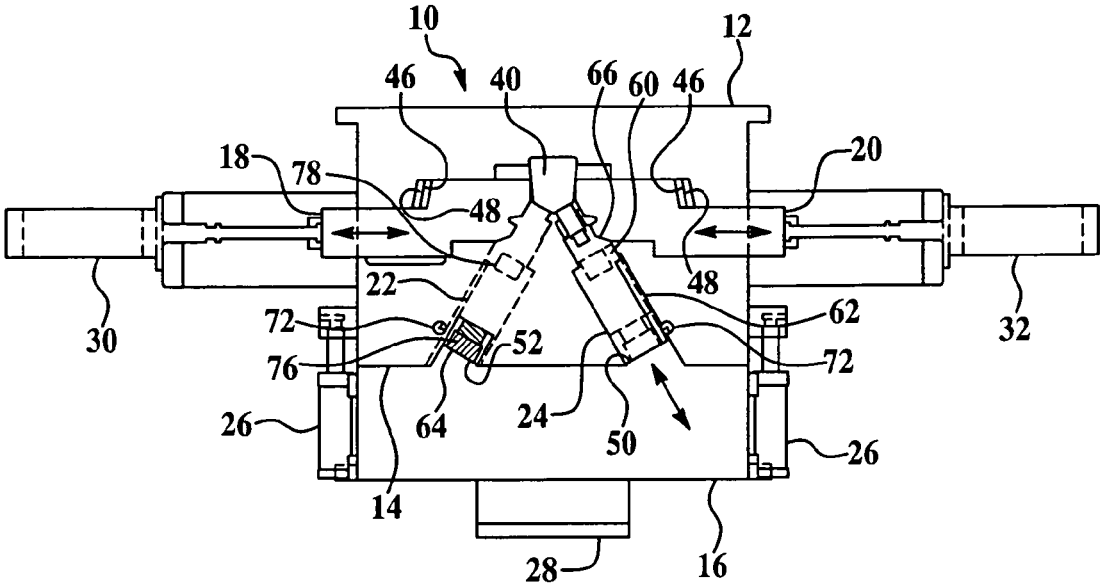
FIG. 1 is a top view of the die-casting apparatus of the present invention.

The engine block die-casting apparatus of the present invention is generally indicated at 10 in FIG. 1. It should be appreciated by those having ordinary skill in the art that the engine block die-casting apparatus 10 of the present invention may be configured to produce a variety of engine block types having any number of cylinders. However, as an illustrative example, the engine block die-casting apparatus 10 described herein is configured to produce "V" type engine blocks. Referring to FIG. 1, the engine block die-casting apparatus 10 includes a stationary element 12, an ejector holder block 14 adapted to be operatively movable to and from said stationary element 12, an ejector box 16, a pair of side core slides 18 and 20, and at least one bank core slide assembly slidably mounted to and operatively moveable within the ejector holder block 14 that is adapted to be mechanically actuated. In the preferred embodiment illustrated in FIG. 1 where the apparatus 10 is configured to produce a "V" engine block casting, a pair of bank slide core assemblies 22 and 24 are utilized.

A pair of actuators 26 are mounted between the ejector holder block 14 and the ejector box 16 for operatively moving the ejector holder block 14 linearly toward and away from the ejector box 16. An actuator 28 operatively and collectively moves the ejector block 14 and the ejector box 16 toward and away from the stationary element 12. The pair of side core slides 18 and 20 are mounted to the ejector holder block 14. Actuators 30 and 32 move the side core slides 18, 20 respectfully, toward and away from each other in a direction perpendicular to the movement of the ejector holder block 14 and the ejector box 16.

The pair of bank slide core assemblies 22 and 24 are mounted to the ejector holder block 14 obliquely with respect to the direction of movement of the ejector holder block 14, the ejector box 16 and the movable side cores 18 and 20. As will be discussed in detail below, the bank slide core assemblies 22 and 24 are operatively movable and mechanically actuated toward and away from the stationary element 12 along their oblique mounting angle in the ejector holder block 14. More specifically, the within the ejector holder block 14, the bank core slide assemblies 22 and 24 are operatively moved between an extended position and a retracted position. The extended position places the bank core slide assemblies 22 and 24 closest to the stationary element 12 when the die is closed to form the cylinder openings in the engine block. When the engine block is cast and is ready to be ejected from the engine block die-casting apparatus 10, the bank core slide assemblies 22, 24 are drawn back within the ejector holder block 14 to the retracted position to allow the casting to be ejected.

In this manner, to close the die, the side core slides 18 and 20 are first driven inward toward each other along the ejector holder block 14. Then, the bank slide core assemblies 22 and 24 are driven forward toward the stationary element 12, and the ejector box 16 is driven to engage against the ejector holder block 14. Finally, the side core slides 18, 20, the bank slide core assemblies 22, 24, the ejector holder block 14, and the ejector box 16 are driven as a group toward the stationary element 12 to close the die and form a die cavity 40. Thus, the stationary element 12, the ejector holder block 14, the pair of side slide cores 18 and 20, and the bank core slide assemblies 22 and 24 are adapted to be moved proximate each other so as to create a closed die-cast cavity 40 and to be drawn apart from one another to allow extraction of the finished engine block.

To lock the die cavity 40 closed and to establish and maintain dimensional stability of the die cores, the stationary element 12 includes sloped locking surfaces 46 that operatively interface with cooperative locking faces 48 on each of the side core slides 18 and 20. The ejector box 16 also includes obliquely angled locking surfaces 50 that operatively engage the rear end 52 of the bank core slide assemblies 22 and 24. Thus, the die elements and cores of the die-casting apparatus 10 are cooperatively locked together to provide a die cavity 40 having the capability to withstand the high pressure injection of molten metal to form the desired engine block. It should be appreciated that the above order of movement of the elements of the die-casting apparatus 10 is not meant to be limiting and the die elements and cores may be operatively moved in any manner that achieves the end result of locking the die elements and cores together as illustrated in FIG. 1.

Figure 2:
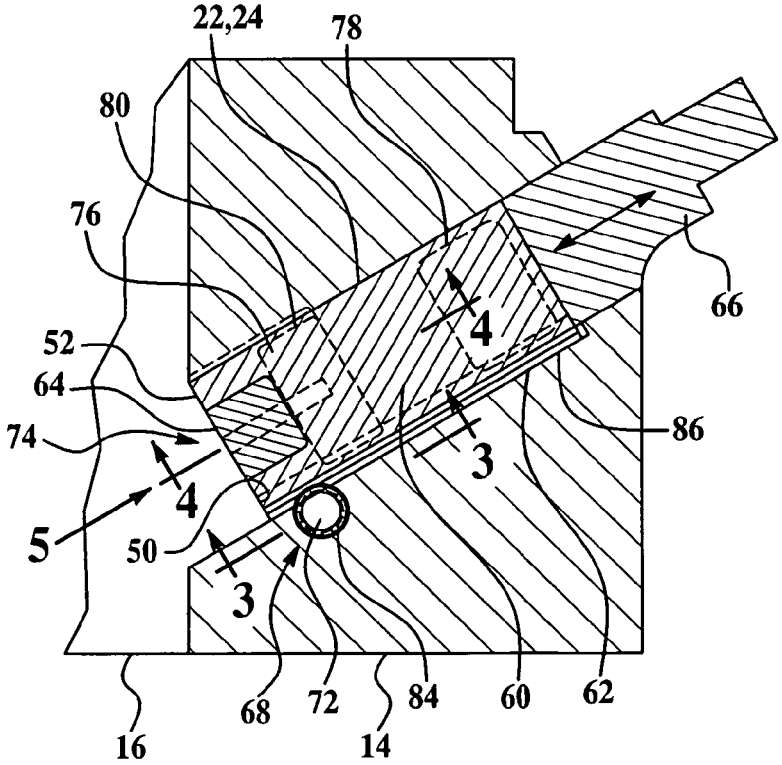
FIG. 2 is a partial cross-sectional top view of the die-casting apparatus of the present invention illustrating details of the bank core slide assemblies and ejector holder block of FIG. 1.
Figure 3:
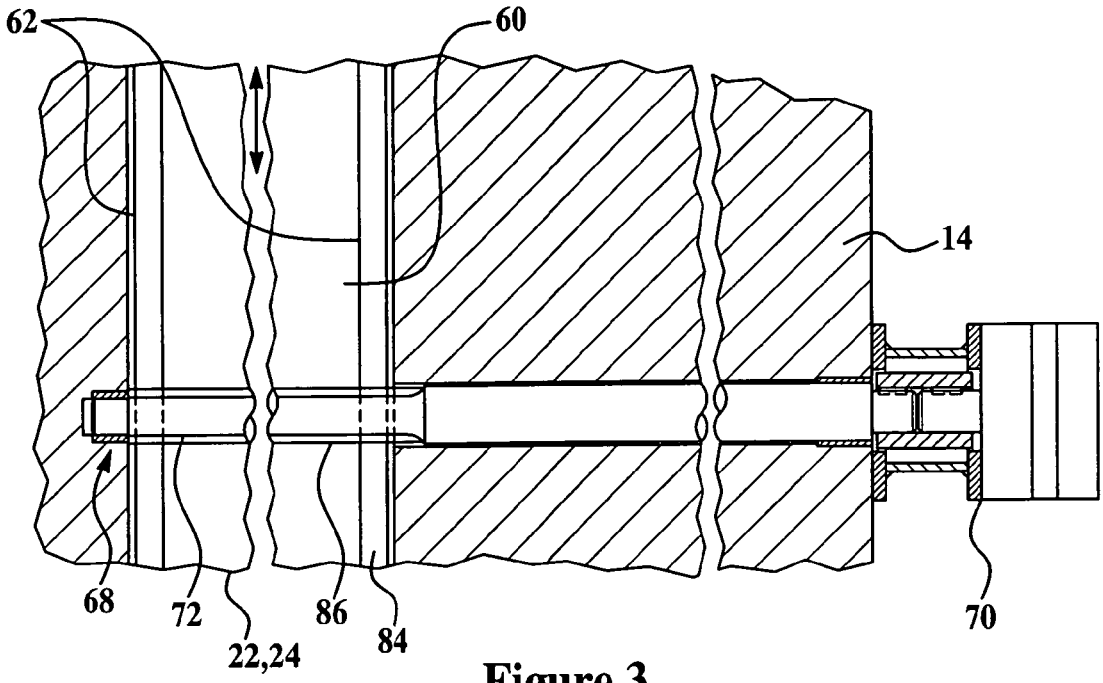
FIG. 3 is partial cross-sectional side view of the die-casting apparatus of the present invention illustrating details of the bank core slide assembly and ejector block holder taken across reference line 3-3 of FIG. 2.

As shown in greater detail in FIGS. 2 and 3, the bank core slide assemblies 22, 24 and ejector holder block 14 include additional structure to overcome the disadvantages and shortcomings of the conventional engine block die-casting apparatuses. More specifically, the bank core slide assemblies 22, 24 each include a bank core carrier 60, a pair of racks 62, a bank core slide end plate 64, a plurality of bank core inserts 66, and a bank core slide drive assembly 68. Each bank core slide drive assembly 68 further includes a drive motor 70 and a drive pinion shaft 72 operatively engaged to it respective pair of racks 62 and adapted to operatively move the bank core slide assembly 22, 24 along the pair of racks 62 within the ejector holder block 14.

FIG. 2 illustrates the bank core slide assembly 24 operatively positioned forward in the ejector holder block 14 and locked by the sloped locking surface 50 of the ejector box 16. When the ejector box 16 is drawn away from the ejector holder block 14, the bank core slide assemblies 22, 24 may be withdrawn by actuating the drive motors 70, which operatively turn the drive pinion shafts 72. The drive pinion shafts include pinion gear teeth 84 that operatively engage rack teeth 86 on the racks 62, which are fixedly mounted to the bank core carrier 60 of the bank core slide assemblies 22, 24. It should be appreciated that the plurality of core inserts 66 are fixedly mounted to the bank core carrier 60 in such a manner as to allow them to be easily replaceable when they wear beyond a predetermined dimensional tolerance. Thus, the present invention allows replacement of each of the plurality of bank core inserts 66 without having to remove the bank core slide assemblies 22, 24 from the engine block die-casting apparatus 10 or without disassembling the engine block die-casting apparatus 10. It should be further appreciated that the plurality of core inserts 66 mounted to each bank core carrier 60 provides the desired number of cores to produce the desired number of cylinder bores in the cast engine block.

The actuation of the drive motor 70 and the interaction of the pinion gear teeth 84 and the rack teeth 86 cause the bank core carrier 60, and thus the entire bank core slide assembly 22 or 24, to move back in the ejector holder block 14 away from the die cavity 40. However, if a casting process has been completed, the bank core inserts 66 will be surrounded and held by the adhesion of the cast metal of the newly formed engine block cylinder walls (not shown) thereby preventing the drive motor 70 from extracting the bank core slide assemblies 22, 24. To overcome the adhesion of the newly cast metal on the bank core inserts 66 the ejector holder block further includes a plurality of pancake cylinder assemblies, generally indicated at 74, that are adapted to break the adhesion and initially release the plurality of bank core inserts 66 from finished engine block after casting has been completed. Thus, during each operative casting cycle, the pancake cylinder assemblies 74 are first actuated to act upon the bank core slide end plates 64 to overcome the adhesion of the cast metal upon the core inserts 66 before the bank core slide drive assemblies 68 are actuated.

Figure 4:
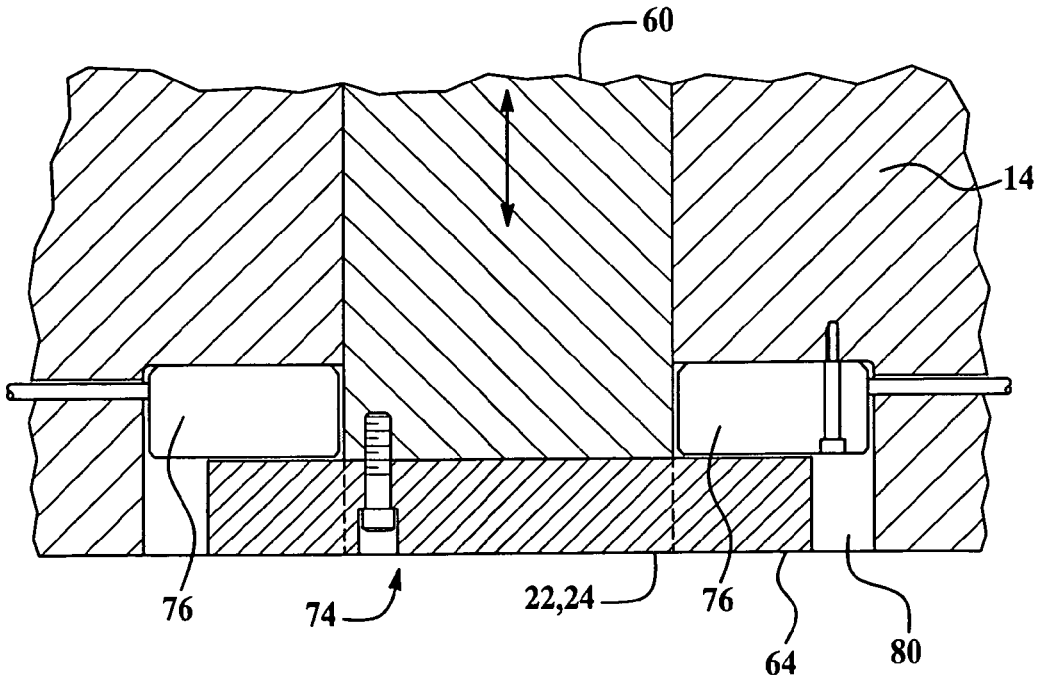
FIG. 4 is partial cross-sectional side view of the die-casting apparatus of the present invention illustrating details of the bank core slide assembly and ejector block holder taken across reference line 4-4 of FIG. 2.
Figure 5:
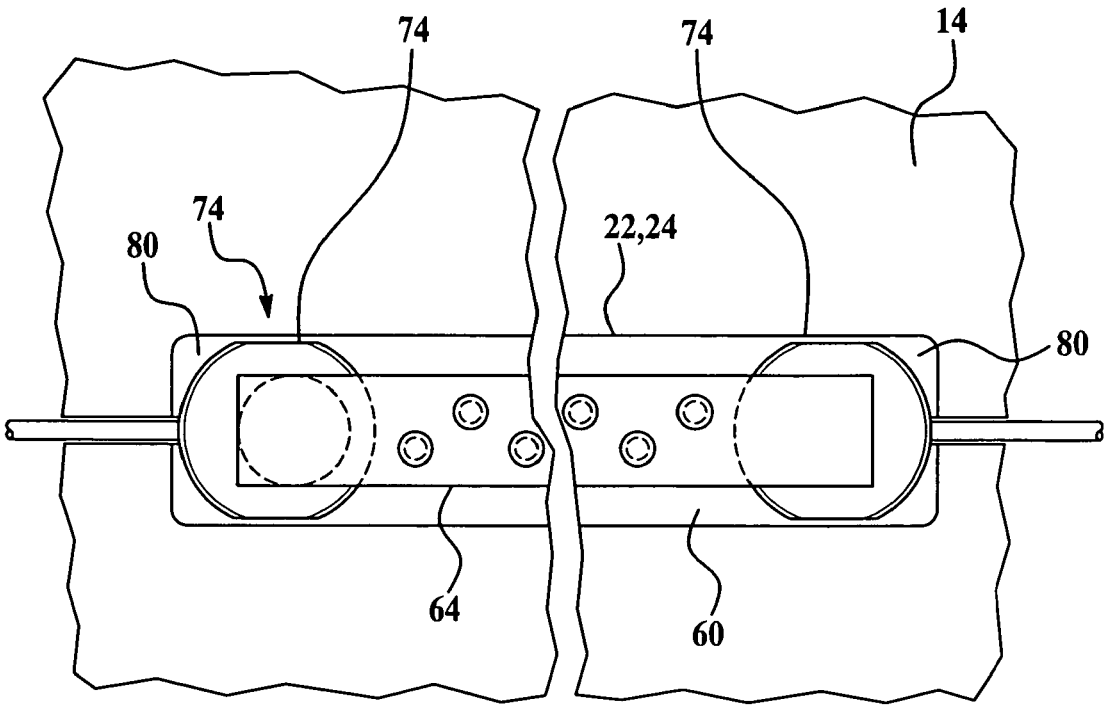
FIG. 5 is partial cross-sectional end view of the die-casting apparatus of the present invention illustrating details of the bank core slide assembly and ejector block holder taken in the direction of reference line 5 of FIG. 2.

As best shown in FIG. 4, the pancake cylinder assemblies 74 include two hydraulically actuated "pancake" type cylinders 76 that are fixedly mounted in a recess 80, which is formed in the ejector holder block 14. The recesses 80, and the pancake cylinders 76 are disposed within the ejector holder block 14 so as to be above and below the bank core slide assemblies 22, 24, as illustrated in FIGS. 1 and 2. As previously discussed, the bank core slide assemblies 22, 24 are operatively driven within in the ejector holder block 14 so as to insert or extract the bank core inserts 66 from the die cavity and the cast engine block. As shown in FIGS. 2 and 4, when the bank core slide assemblies 22, 24 are fully inserted in the ejector holder block 14 the bank core slide end plate 64 rests against the pancake cylinders 76.

The pancake cylinders 76 only need to actuate against the bank core slide end plate 64 for a short distance to break the core inserts 66 free of the adhesion of the cast cylinder wall metal. The drive motor 70 is then capable of providing enough torque and motive power to drive the bank core slide assemblies 22, 24 back and extract the core inserts 66 the remaining distance along the cast cylinder walls of the newly formed engine block. The drive motor 70 retracts the bank core slide assemblies 22, 24 until the core inserts 66 clear the casting. It should be appreciated that the drive motor 70 may be any type of device that provides rotational motive force to the pinion drive shaft 72. However, in the preferred embodiment, the drive motor 70 is a hydraulic motor to take advantage of the pressurized hydraulic fluid that is already utilized in the die-casting apparatus 10 for movement of the ejector holder block 14, the ejector box 16, and the side core slides 18 and 20.

Due to the substantial operative surface area of the pancake cylinders 76 and the short distance that they are required to actuate over, it will be appreciated that the volume of pressurized hydraulic fluid flow that must be delivered to break the core inserts 66 free is minimized. Furthermore, by utilizing a drive motor 70 to operatively drive the pinion shaft 72 and rack 62 actuation of the bank core slide assemblies 22, 24, the need for large complex hydraulic cylinders and their associated hardware to insert and extract the bank core slide assemblies 22, 24 into and out of the die cavity 40, as in conventional die-casting machines, has been eliminated.

Additionally, as best shown in FIG. 2, in contrast to conventional die-casting machines, the elimination of hydraulic cylinders and actuators that are directly connected to the rear portion of the bank core slide assemblies in the present invention, allows the ejector box 16 of the die-casting apparatus 10 of the present invention to completely enclose and lock against the rear 52 of the bank core slide assemblies 22, and 24. More specifically, when the bank core slide assemblies 22 and 24 are driven forward toward the die cavity 40 and the ejector box 16 is driven forward to lock the bank core slide assemblies 22, 24 in place, the obliquely angled locking surfaces 50 seat directly against the bank core slide end plates 64. This direct interface between the ejector box 16 and the bank core slide assemblies 22, 24 provides enhanced dimensional stability to the bank core slide assemblies 22 and 24 and thus, to the core inserts 66 for stable formation of the cylinder wall in the engine block casting.

As previously described, conventional die-casting machines do not have provisions for the automated clearing and cleaning of flash debris from the die element and core surfaces. Nor do conventional die-casting machines have provisions for the cooling of the bank core slide assemblies and core inserts. However, the ejector holder block 14 of the present invention is structured to overcome these disadvantages and shortcomings with conventional engine block die-casting machines. As shown in FIGS. 1 and 2, the ejector holder block 14 includes a debris clearing opening 78. The debris clearing opening 78 provides an open pathway though the ejector holder block 14 along the forward face of the bank core slide assemblies 22,24. When the bank core slide assemblies 22, 24 are moved forward and the core inserts 66 are extended, the debris clearing openings 78 are blocked. When the core inserts 66 and bank core slide assemblies 22, 24 are freed from the cast engine block by the pancake cylinders 76 and the bank core slide assemblies 22, 24 are withdrawn, a source of pressurized media is provided to the debris clearing openings 78.

It should be appreciated that the different pressurized media may be employed based on the desired effects. For example, pressurized air may be employed in certain circumstances. Thus, as the bank core slide assemblies 22, 24 are withdrawn and the debris openings 78 become unblocked, a flow of pressurized air is directed over the forward face of the bank core slide assemblies 22, 24 and over and around the core inserts 66. This blast of rushing air through the debris clearing openings 78 blows free the residual casting flash and debris and clears the bank core slide assemblies 22, 24 and the core inserts 66. The loosened flash and debris is ejected through the debris clearing opening 78 and out of the ejector holder block 14. In this manner, the flash and debris clearing operation of the present invention may be an automated function that eliminates the need for human intervention in the casting process, thereby providing costs savings in labor and time. It should be appreciated that the flow if pressurized air may be directed either upward or downward through the ejector holder block 14 to clear the flash and debris form the die elements and cores. It should be further appreciated that the flow of pressurized air may be maintained as the bank core slide assemblies 22, 24 are withdrawn to provide directed cooling to the core inserts 66, the ejector holder block 14, and the surrounding elements.

Furthermore, as another example, the pressurized media may be a predetermined liquid that would be employed at a predetermined temperature and have particularly desired heat transfer and cooling properties to provide both a specialized cooling and debris clearing function simultaneously. In this example, the liquid media would be routed under pressure through the debris clearing openings 78, then filtered, re-cooled, and recycled to provide a continuous delivery of clean liquid cooling media that to provide the debris clearing function in the die-casting apparatus. Thus, directed cooling is provided to the core inserts 66, the ejector holder block 14, and the surrounding elements, while the debris clearing and flushing function is being performed. In this manner, the die elements and cores are operatively cooled between the casting operations to extend the life of the core inserts 66 and other related elements thereby lowering maintenance costs, repairs costs, and down time.

Thus, the present invention overcomes the inefficiencies and high operational and maintenance costs of conventional die-casting machines employed to produce engine blocks by eliminating the requirement for large complex hydraulic cylinders and their associated hardware to insert and extract the bank core slide assemblies 22, 24 into and out of the die cavity 40. By employing mechanically actuated bank core slide assemblies 22, 24, the present invention ensures an accurate, highly repeatable, and dimensional stable placement of the bank core slide assemblies 22, 24 in the die cavity 40. Additionally, by eliminating the complex arrangement of hydraulic cylinders and actuators that are normally mounted to the rear portion of the bank core slide assemblies in conventional die-casting machines, the present invention allows the ejector box 16 to completely enclose and lock against the rear 52 of the bank core slide assemblies 22, and 24. This locking feature provides further enhanced dimensional stability of the bank core slide assemblies 22 and 24 over that of the conventional die-casting machines.

Furthermore, the present invention overcomes the disadvantages of conventional die-casting machines employed to produce engine blocks by providing debris clearing openings 78 in the ejector holder block 16 that have a combined function of providing automated clearing of the flash and debris formed during the casting process while providing for the operative cooling of the core inserts 66 between the casting cycles. This allows full automation of the casting process, speeds the recycle time between castings, and extends the life of the core inserts and the related components of the die-casting apparatus.

The invention has been described in an illustrative manner. It is to be understood that the terminology that has been used is intended to be in the nature of words of description rather than of limitation. Many modifications and variations of the invention are possible in light of the above teachings. Therefore, within the scope of the appended claims, the invention may be practiced other than as specifically described.

We claim:

1. An engine block die-casting apparatus having at least one bank core slide assembly comprising:

a bank core carrier;

a pair of racks mounted to said bank core carrier, adapted to actuate said bank core slide assembly, and along which said bank core slide assembly is adapted to operatively move within said apparatus;

a plurality of bank core inserts mounted to said bank core carrier and adapted to be inserted into and extracted from a die cavity and cast engine block by said bank core slide assembly to provide a corresponding number of cores to produce a corresponding number of cylinder bores in the cast engine block;

a bank core slide drive assembly adapted to be actuated to operatively move said bank core slide assembly along said pair of racks within said apparatus; and a bank core slide end plate adapted to rest against and be acted upon by said apparatus to overcome adhesion of cast metal upon said plurality of bank core inserts, wherein said bank core slide assembly is slidably mounted and mechanically actuated within said apparatus and each of said plurality of bank core inserts further includes at least one debris-clearing opening adapted to allow flow of a pressurized medium to move through said opening to clear residual casting flash and debris and provide cooling to said bank core slide assembly and plurality of bank core inserts.

2. An engine block die-casting apparatus as set forth in claim 1 wherein said bank core slide drive assembly further includes a drive motor and drive pinion shaft operatively engaged to said pair of racks and adapted to operatively move said bank core slide assembly along said pair of racks within said engine block die-casting apparatus.

3. An engine block die-casting apparatus as set forth in claim 1 wherein each of said plurality of bank core inserts is fixedly mounted to said bank core carrier so as to allow said plurality of bank core inserts to be replaced without removing said bank core slide assemblies from said apparatus and without disassembly of said apparatus.

4. An engine block die-casting apparatus comprising:

a stationary element;

an ejector box adapted to be moved toward and away from said stationary element;

an ejector holder block adapted to operatively move toward and away from said ejector box and having at least one bank core slide assembly slidably mounted and mechanically actuated within said ejector holder block between an extended position and a retracted position;

at least one bank core slide drive assembly adapted to be actuated to operatively move said bank core slide assembly within said ejector holder block between said extended and retracted positions;

a plurality of bank core inserts mounted to said bank core slide assembly and adapted to be inserted into and extracted from a die cavity and cast engine block by said bank core slide assembly to provide a corresponding number of cores to produce a corresponding number of cylinder bores in the cast engine block; and a plurality of pancake cylinder assemblies adapted to be actuated by said ejector box and initially release said plurality of bank core inserts from a finished engine block after casting of a corresponding engine block has been completed.

5. An engine block die-casting apparatus as set forth in claim 4 wherein said at least one bank core slide assembly further includes an end plate and said ejector box includes at least one obliquely angled locking surface, said at least one obliquely angled locking surface adapted to seat directly against said bank core slide end plate to lock said at least one bank core slide assembly in place when said at least one bank core slide assembly is in said extended position.

6. An engine block die-casting apparatus as set forth in claim 4 wherein said ejector holder block further includes at least one recess and one of said plurality of pancake cylinder assemblies is fixedly mounted within said at least one recess such that when said at least one bank core slide assembly is in said extended position within said ejector holder block, said bank core slide end plate rests against one of said plurality of pancake cylinder assemblies.

7. An engine block die-casting apparatus as set forth in claim 4 wherein said bank core slide drive assembly further includes a drive motor and drive pinion shaft operatively engaged to said at least one bank core slide assembly and adapted to operatively move said bank core slide assembly within said engine block die-casting apparatus between said extended position and said retracted position.

8. An engine block die-casting apparatus as set forth in claim 4 wherein each of said plurality of bank core inserts is fixedly mounted to said at least one bank core slide assembly so as to allow said plurality of bank core inserts to be replaced without removing said bank core slide assembly from said engine block die-casting apparatus and without disassembly of said engine block die-casting apparatus.

9. An engine block die-casting apparatus as set forth in claim 4 wherein each of said plurality of bank core inserts further includes at least one debris clearing opening adapted to allow the flow of a pressurized medium to move through said opening to clear residual casting flash and debris and provide cooling to said at least one bank core slide assembly and plurality of core inserts.

10. An engine block die-casting apparatus comprising:

a stationary element;

an ejector box adapted to be moved toward and away from said stationary element;

an ejector holder block adapted to operatively move toward and away from said ejector box and be operatively movable to and from said stationary element;

a pair of side core slides mounted to said ejector holder block and adapted to be moved toward and away from each other and operatively interface with said stationary element; and at least one bank core slide assembly slidably mounted and mechanically actuated to and operatively moveable within said ejector holder block, wherein said stationary element, said ejector holder block, said pair of side core slides, and said at least one bank core slide assembly are adapted to be moved proximate each other so as to create a closed die-cast cavity and to be drawn apart from one another to allow extraction of a cast engine block and said at least one bank core slide assembly has a bank core carrier, a pair of racks, a bank core slide end plate, a plurality of bank core inserts, and a bank core slide drive assembly and said ejector holder block further includes a plurality of pancake cylinder assemblies adapted to initially release said plurality of bank core inserts from the cast engine block after casting of an engine block has been completed.

11. An engine block die-casting apparatus as set forth in claim 10 wherein said bank core slide drive assembly further includes a drive motor and drive pinion shaft operatively engaged to said pair of racks and adapted to operatively move said at least one bank core slide assembly along said pair of racks within said ejector holder block between an extended position and a retracted position.

12. An engine block die-casting apparatus as set forth in claim 10 wherein said ejector box includes at least one obliquely angled locking surface adapted to seat directly against said bank core slide end plate when said die-cast cavity is closed and said at least one bank core slide assembly is in said extended position so as to lock said at least one bank core slide assembly in place.

13. An engine block die-casting apparatus as set forth in claim 12 wherein said ejector holder block further includes at least one recess and one of said plurality of pancake cylinder assemblies is fixedly mounted within said at least one recess such that when said at least one bank core slide assembly is in said extended position within said ejector holder block, said bank core slide end plate rests against one of said plurality of pancake cylinder assemblies.

14. An engine block die-casting apparatus as set forth in claim 10 wherein each of said plurality of bank core inserts is fixedly mounted to said bank core slide assembly so as to allow said plurality of bank core inserts to be replaced without removing said bank core slide assemblies from said apparatus and without disassembly of said apparatus.

15. An engine block die-casting apparatus as set forth in claim 10 wherein each of said plurality of bank core inserts further includes at least one debris clearing opening adapted to allow flow of a pressurized medium to move through said opening to clear residual casting flash and debris and provide cooling to said at least one bank core slide assembly and plurality of core inserts.

16. An engine block die-casting apparatus comprising:

a stationary element;

an ejector box adapted to be moved toward and away from said stationary element;

an ejector holder block adapted to operatively move toward and away from said ejector box and be operatively movable to and from said stationary element;

a pair of side core slides mounted to said ejector holder block and adapted to be moved toward and away from each other and operatively interface with said stationary element; and at least one bank core slide assembly slidably mounted and mechanically actuated to and operatively moveable within said ejector holder block between an extended position and a retracted position, wherein said stationary element, said ejector holder block, said pair of side core slides, and said at least one bank core slide assembly are adapted to be moved proximate each other so as to create a closed die-cast cavity and to be drawn apart from one another to allow extraction of a cast engine block, said at least one bank core slide assembly has a bank core carrier, a pair of racks, a bank core slide end plate, a plurality of bank core inserts, and a bank core slide drive assembly, said at least one bank core slide assembly further includes an end plate, said ejector box includes at least one obliquely angled locking surface adapted to seat directly against said bank core slide end plate when said die-cast cavity is closed and said at least one bank core assembly is in said extended position so as to lock said at least one bank core slide assembly in place, and said ejector holder block further includes at least one recess and a plurality of pancake cylinder assemblies one of which is fixedly mounted within said at least one recess such that when said at least one bank core slide assembly is in said extended position within said ejector holder block, said bank core slide end plate rests against one of said plurality of pancake cylinder assemblies.

17. An engine block die-casting apparatus comprising:

a stationary element;

an ejector box adapted to be moved toward and away from said stationary element;

an ejector holder block adapted to operatively move toward and away from said ejector box and be operatively movable to and from said stationary element;

a pair of side core slides mounted to said ejector holder block and adapted to be moved toward and away from each other and operatively interface with said stationary element; and at least one bank core slide assembly slidably mounted and mechanically actuated to and operatively moveable within said ejector holder block, wherein said stationary element, said ejector holder block, said pair of side core slides, and said at least one bank core slide assembly are adapted to be moved proximate each other so as to create a closed die-cast cavity and to be drawn apart from one another to allow extraction of a cast engine block, said at least one bank core slide assembly has a bank core carrier, a pair of racks, a bank core slide end plate, a plurality of bank core inserts, and a bank core slide drive assembly, and each of said plurality of bank core inserts includes at least one debris clearing opening adapted to allow flow of a pressurized medium to move through said opening to clear residual casting flash and debris and provide cooling to said at least one bank core slide assembly and plurality of bank core inserts.

* * * * *